US011414817B2

(12) United States Patent
Zhang et al.

(10) Patent No.: US 11,414,817 B2
(45) Date of Patent: Aug. 16, 2022

(54) ARAMID PAPER COATED WITH ARAMID NANOFIBERS AND A METHOD OF PREPARING THE SAME

(71) Applicants: Meiyun Zhang, Xi'an (CN); Jiaojun Tan, Xi'an (CN); Bin Yang, Xi'an (CN); Shunxi Song, Xi'an (CN); Jingyi Nie, Xi'an (CN); Xue Jiang, Xi'an (CN)

(72) Inventors: Meiyun Zhang, Xi'an (CN); Jiaojun Tan, Xi'an (CN); Bin Yang, Xi'an (CN); Shunxi Song, Xi'an (CN); Jingyi Nie, Xi'an (CN); Xue Jiang, Xi'an (CN)

(73) Assignee: SHAANXI UNIVERSITY OF SCIENCE AND TECHNOLOGY, Xi'an (CN)

( * ) Notice: Subject to any disclaimer, the term of this patent is extended or adjusted under 35 U.S.C. 154(b) by 176 days.

(21) Appl. No.: 17/074,866

(22) Filed: Oct. 20, 2020

(65) Prior Publication Data

US 2021/0254286 A1 Aug. 19, 2021

(30) Foreign Application Priority Data

Feb. 17, 2020 (CN) ..... 202010097567.0

(51) Int. Cl.

| | |
|---|---|
| ***D21H 13/26*** | (2006.01) |
| ***D21H 15/10*** | (2006.01) |
| ***D21H 17/67*** | (2006.01) |
| ***D21H 21/08*** | (2006.01) |
| *D06M 101/36* | (2006.01) |

(52) U.S. Cl.

CPC ..... *D21H 13/26* (2013.01); *D21H 15/10* (2013.01); *D21H 17/675* (2013.01); *D21H 21/08* (2013.01); *D06M 2101/36* (2013.01)

(58) Field of Classification Search

CPC ..... D21H 15/02; D21H 21/08; D21H 13/26; D21H 15/10; D21H 21/52; D21H 17/675; D06M 2101/36

USPC ..... 162/157

See application file for complete search history.

(56) References Cited

U.S. PATENT DOCUMENTS

| | | | | |
|---|---|---|---|---|
| 9,434,142 | B2 * | 9/2016 | Levit | B32B 37/02 |
| 2009/0145842 | A1 * | 6/2009 | Frances | B01D 39/04 210/505 |

FOREIGN PATENT DOCUMENTS

| | | | |
|---|---|---|---|
| CN | 106948210 | B | 6/2018 |
| CN | 108316056 | A | 7/2018 |
| CN | 110205862 | A | 9/2019 |

* cited by examiner

*Primary Examiner* — Mark Halpern

(57) ABSTRACT

A method of preparing an aramid paper coated with aramid nanofibers includes the following steps: (1) mixing a meta-aramid fibrid slurry and a chopped meta-aramid fiber slurry, filtering, pressing and drying to obtain a meta-aramid paper; (2) mixing potassium hydroxide, deionized water, dimethyl sulfoxide, and para-aramid nanofibers in a container, and stirring to obtain a para-aramid nanofiber coating solution; and (3) applying the para-aramid nanofiber coating solution to a first side of the meta-aramid paper, washing with deionized water, and drying; applying the para-aramid nanofiber coating solution to a second side of the meta-aramid paper, washing with deionized water, and drying; and hot pressing to obtain the aramid paper coated with aramid nanofibers.

9 Claims, 3 Drawing Sheets

ARAMID PAPER COATED WITH ARAMID NANOFIBERS AND A METHOD OF PREPARING THE SAME

The present invention claims priority to Chinese Application No. 202010097567.0, filed Feb. 17, 2020, which is incorporated by reference for all purposes as if fully set forth herein.

FIELD OF THE INVENTION

The invention relates to polymer nano materials and papermaking coating technology, in particular to aramid paper coated with aramid nanofibers and a method of preparing the same.

BACKGROUND OF THE INVENTION

In the 1960s, DuPont used chopped aramid and aramid pulp fibers as raw materials to successfully develop aramid-based paper using papermaking methods, which have been widely used in the fields of motors, transformers, and flexible composite insulation materials. With the rapid development of the electrical industry, the industry continues to upgrade high-voltage motor insulation, which requires higher requirements for the performance and reliability of insulating materials. Aramid nanofibers (ANFs) refer to aromatic polyamide fibers in nanometer sizes, which not only retain the excellent mechanical properties, acid and alkali resistance, high temperature resistance, and flame retardancy of the aramid fibers, but also have nano-scale reinforcement effects. The method of introducing aramid nanofibers into aramid paper to improve the strength and insulation properties of the material is also popular. Chinese patent application publication CN108316056A, entitled "an aramid nanofiber film composite aramid paper and its preparation method," discloses a wet paper making method. A surface layer, a core layer and a bottom layer are prepared by the wet paper making method. Chinese patent application publication CN110205862A, entitled "a preparation method of aramid nanofiber self-reinforced aramid mica paper," discloses the addition of aramid nanofiber mica ball milling to the aramid fiber slurry and the preparation of aramid nanofiber self-reinforced aramid mica paper.

These methods include a wet forming step. Due to the size effect, the aramid nanofibers have a large amount of loss in the mesh. There is the problem of slow water filtration, which will seriously affect the cost of production and industrial application.

SUMMARY OF THE INVENTION

In one embodiment, the present application provides a method of preparing an aramid paper coated with aramid nanofibers. The method includes the following steps: (1) mixing a meta-aramid fibrid slurry and a chopped meta-aramid fiber slurry, filtering, pressing and drying to obtain a meta-aramid paper; (2) mixing potassium hydroxide, deionized water, dimethyl sulfoxide, and para-aramid nanofibers in a container, and stirring to obtain a para-aramid nanofiber coating solution; and (3) applying the para-aramid nanofiber coating solution to a first side of the meta-aramid paper, washing with deionized water, and drying; applying the para-aramid nanofiber coating solution to a second side of the meta-aramid paper, washing with deionized water, and drying; and hot pressing to obtain the aramid paper coated with aramid nanofibers.

In another embodiment, in the step (1), a dry mass ratio of the meta-aramid fibrid slurry and the chopped meta-aramid fiber slurry is (0-50):(100-50).

In another embodiment, in the step (1), the meta-aramid fibrid slurry and a chopped meta-aramid fiber slurry are stirred at 20,000 rpm, then at 3,000 rpm, and filtered, pressed and dried in a papermaking machine to obtain the meta-aramid paper.

In another embodiment, a paper weight of the meta-aramid paper obtained in the step (1) is 60 g/m$^2$.

In another embodiment, in the step (2), a weight ratio of the potassium hydroxide:the deionized water:the dimethyl sulfoxide:the para-aramid nanofibers is (3.75-15):20:500:(2.5-10).

In another embodiment, in the step (2), the potassium hydroxide, the deionized water, the dimethyl sulfoxide, and the para-aramid nanofibers are stirred for 4 hours.

In another embodiment, in the para-aramid nanofiber coating solution of the step (2), the para-aramid nanofibers have a weight concentration of 0.5%-2% based on an amount of the dimethyl sulfoxide.

In another embodiment, in the step (3), the first side of the meta-aramid paper is washed with the deionized water for 0.5-2 hours, dried at 105° C. for 3-8 minutes; and the second side of the meta-aramid paper is washed with the deionized water for 0.5-2 hours, dried at 105° C. for 3-8 minutes.

In another embodiment, in the step (3), the meta-aramid paper is hot pressed at 150-200° C., at a pressure of 5-10 MPa, for 3-20 minutes.

In another embodiment, the present invention discloses an aramid paper coated with aramid nanofibers prepared by the method of present invention.

Compared with the prior art, the present invention has the following beneficial technical effects:

(1) The present invention applies a simple and effective coating method to coat aramid paper, reduces the loss of aramid nanofibers, avoids the problem of slow water filtration speed, and provides a suitable method for industrial production.

(2) In the present invention, aramid nanofibers are coated on aramid paper, and the aramid nanofibers form a dense film on the surface of the aramid paper, which reduces the porosity of the material, reduces the passage of electrons, and improves the insulation performance of the material. The absorption of glue solution is reduced and the post-processability is improved. The invention provides a new way for the use of aramid nanofibers.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, example of which is illustrated in the accompanying drawings.

Figure 1:
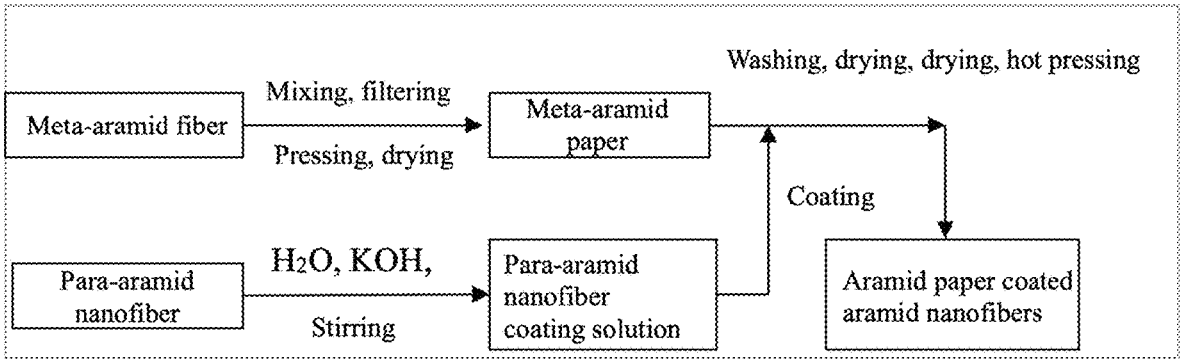
FIG. 1 is a schematic diagram of the technical process of the present invention.

A schematic diagram of the technical process of the present invention is shown in FIG. 1. Specifically, a method of preparing aramid paper coated with aramid nanofibers includes the following steps:

(1) The preparation of aramid paper: chopped meta-aramid fiber and meta-aramid fibrid were dissolved in water at 20,000 rpm to form a chopped meta-aramid fiber slurry and a meta-aramid fibrid slurry. The slurries were mixed in a dry weight ratio of (0-50):(100-50); decomposed at 3,000 rpm; passed through a papermaking filter, pressed, and dried to obtain a meta-aramid paper with a paper weight of 60 g/m$^2$.

(2) Preparation of aramid nanofiber coating solution: potassium hydroxide, deionized water, dimethyl sulfoxide, and para-aramid nanofibers were mixed in a weight ratio of (3.75-15):20:500:(2.5-10). The mixture was placed in a container and stirred for 4 hours to obtain a para-aramid nanofiber coating solution with a weight concentration of 0.5% to 2% based on the weight of the dimethyl sulfoxide.

(3) Preparation of aramid paper coated with aramid nanofibers: the para-aramid nanofiber coating solution was applied to one side of the meta-aramid paper. The meta-aramid paper was washed with deionized water for 0.5-2 hours, and dried at 105° C. for 3-8 minutes. The para-aramid nanofiber coating solution was applied to the other side of the meta-aramid paper. The meta-aramid paper was washed with deionized water for 0.5-2 hours, and dried at 105° C. for 3-8 minutes. The meta-aramid paper was finally heat press for 5-20 minutes at 150-200° C. under 5-10 MPa to obtain the aramid paper coated with aramid nanofibers.

The present invention will be further described in detail below in conjunction with the following examples:

COMPARATIVE EXAMPLE

Meta-aramid paper was prepared by using a paper sheet former. The meta-aramid paper was prepared from a mixture 50% (dry weight) chopped meta-aramid fibers and 50% (dry weight) meta-aramid fibrids. The mixture was pressed and dried to obtain the meta-aramid paper with a paper weight of 60 g/m$^2$. The meta-aramid paper was heat-pressed at 200° C. and under 10 MPa.

Figure 2:
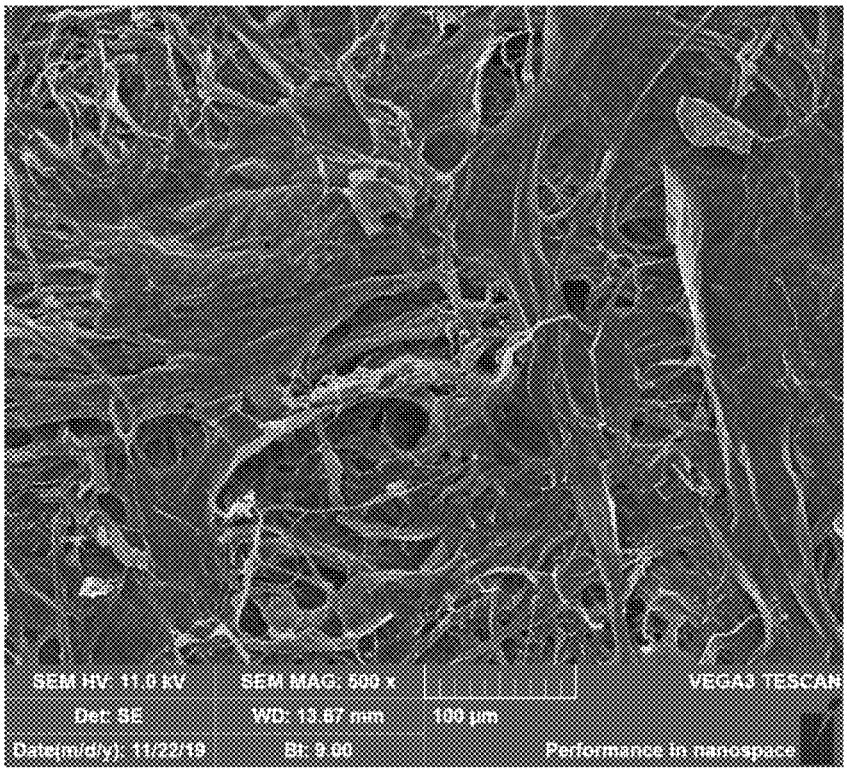
FIG. 2 is a SEM image of the surface of meta-aramid paper.

The aramid paper prepared in this example was tested with a pressure tester. The test results showed that the aramid paper had a compressive strength of 6.5 KV/mm. The tensile strength was 16.4 MPa and the Young's modulus was 0.46 GPa as measured by a servo material control testing machine. FIG. 2 is a SEM image of the surface of meta-aramid paper.

EXAMPLE 1

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 50:50.

(2) Preparation of para-aramid nanofiber coating solution: potassium hydroxide, deionized water, dimethyl sulfoxide, and para-aramid nanofibers were added to a container in a weight ratio of 7.5:20:500:5, and stirred for 4 hours, to obtain the para-aramid nanofiber coating solution. The weight concentration of para-aramid nanofibers was 1% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 30 minutes, and dried for 3 minutes at 105° C. The para-aramid nanofiber coating solution was applied on the other surface of the aramid paper with a coating rod. The coated aramid paper was washed with deionized water for 30 minutes, and dried for 3 minutes at 105° C. The coated aramid paper was finally hot pressed at 150° C. and under 5 MPa for 20 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 7.32 KV/mm. The tensile strength was 18.7 MPa and the Young's modulus was 0.49 GPa as measured by a servo material control testing machine.

EXAMPLE 2

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 50:50.

(2) Preparation of para-aramid nanofiber coating solution: potassium hydroxide, deionized water, dimethyl sulfoxide, and para-aramid nanofibers were added to a container in a weight ratio of 15:20:500:10, and stirred for 4 hours, to obtain the para-aramid nanofiber coating solution. The weight concentration of para-aramid nanofibers was 2% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 1 hour, and dried for 5 minutes at 105° C. The para-aramid nanofiber coating solution was applied on the other surface of the aramid paper with a coating rod. The coated aramid paper was washed with deionized water for 1 hour, and dried for 5 minutes at 105° C. The coated aramid paper was finally hot pressed at 200° C. and under 5 MPa for 10 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 8.7 KV/mm. The tensile strength was 19.2 MPa and the Young's modulus was 0.51 GPa as measured by a servo material control testing machine.

EXAMPLE 3

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 30:70.

(2) Preparation of para-aramid nanofiber coating solution: potassium hydroxide, deionized water, dimethyl sulfoxide, and para-aramid nanofibers were added to a container in a weight ratio of 1:20:500:10, and stirred for 4 hours, to obtain the para-aramid nanofiber coating solution. The weight concentration of para-aramid nanofibers was 2% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 2 hours, and dried for 5 minutes at 105° C. The para-aramid nanofiber coating solution was applied on the other surface of the aramid paper with a coating rod. The coated aramid paper was washed with deionized water for 2 hours, and dried for 5 minutes at 105° C. The coated aramid paper was finally hot pressed at 150° C. and under 5 MPa for 20 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 14.5 KV/mm. The tensile strength was 19.3 MPa and the Young's modulus was 0.59 GPa as measured by a servo material control testing machine.

EXAMPLE 4

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 20:80.

(2) Preparation of para-aramid nanofiber coating solution: potassium hydroxide, deionized water, dimethyl sulfoxide, and para-aramid nanofibers were added to a container in a weight ratio of 15:20:500:10, and stirred for 4 hours, to obtain the para-aramid nanofiber coating solution. The weight concentration of para-aramid nanofibers was 2% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 2 hours, and dried for 8 minutes at 105° C. The para-aramid nanofiber coating solution was applied on the other surface of the aramid paper with a coating rod. The coated aramid paper was washed with deionized water for 2 hours, and dried for 8 minutes at 105° C. The coated aramid paper was finally hot pressed at 180° C. and under 10 MPa for 20 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 16.8 KV/mm. The tensile strength was 20.4 MPa and the Young's modulus was 0.67 GPa as measured by a servo material control testing machine.

EXAMPLE 5

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 10:90.

(2) Preparation of para-aramid nanofiber coating solution: potassium hydroxide, deionized water, dimethyl sulfoxide, and para-aramid nanofibers were added to a container in a weight ratio of 11:20:500:7.5, and stirred for 4 hours, to obtain the para-aramid nanofiber coating solution. The weight concentration of para-aramid nanofibers was 1.5% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 2 hours, and dried for 8 minutes at 105° C. The para-aramid nanofiber coating solution was applied on the other surface of the aramid paper with a coating rod. The coated aramid paper was washed with deionized water for 2 hours, and dried for 8 minutes at 105° C. The coated aramid paper was finally hot pressed at 200° C. and under 5 MPa for 5 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 20.37 KV/mm. The tensile strength was 23.8 MPa and the Young's modulus was 0.7 GPa as measured by a servo material control testing machine.

EXAMPLE 6

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 10:90.

(2) Preparation of para-aramid nanofiber coating solution: potassium hydroxide, deionized water, dimethyl sulfoxide, and para-aramid nanofibers were added to a container in a weight ratio of 3.75:20:500:2.5, and stirred for 4 hours, to obtain the para-aramid nanofiber coating solution. The weight concentration of para-aramid nanofibers was 0.5% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 1 hour, and dried for 8 minutes at 105° C. The para-aramid nanofiber coating solution was applied on the other surface of the aramid paper with a coating rod. The coated aramid paper was washed with deionized water for 1 hour, and dried for 8 minutes at 105° C. The coated aramid paper was finally hot pressed at 150° C. and under 10 MPa for 5 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 19.66 KV/mm. The tensile strength was 21.3 MPa and the Young's modulus was 0.52 GPa as measured by a servo material control testing machine.

EXAMPLE 7

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 10:90.

(2) Preparation of para-aramid nanofiber coating solution: potassium hydroxide, deionized water, dimethyl sulfoxide, and para-aramid nanofibers were added to a container in a weight ratio of 15:20:500:10, and stirred for 4 hours, to obtain the para-aramid nanofiber coating solution. The weight concentration of para-aramid nanofibers was 2% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 2 hours, and dried for 8 minutes at 105° C. The para-aramid nanofiber coating solution was applied on the other surface of the aramid paper with a coating rod. The coated aramid paper was washed with deionized water for 2 hours, and dried for 8 minutes at 105° C. The coated aramid paper was finally hot pressed at 200° C. and under 10 MPa for 10 minutes to obtain the aramid paper coated with aramid nanofibers.

Figure 3:
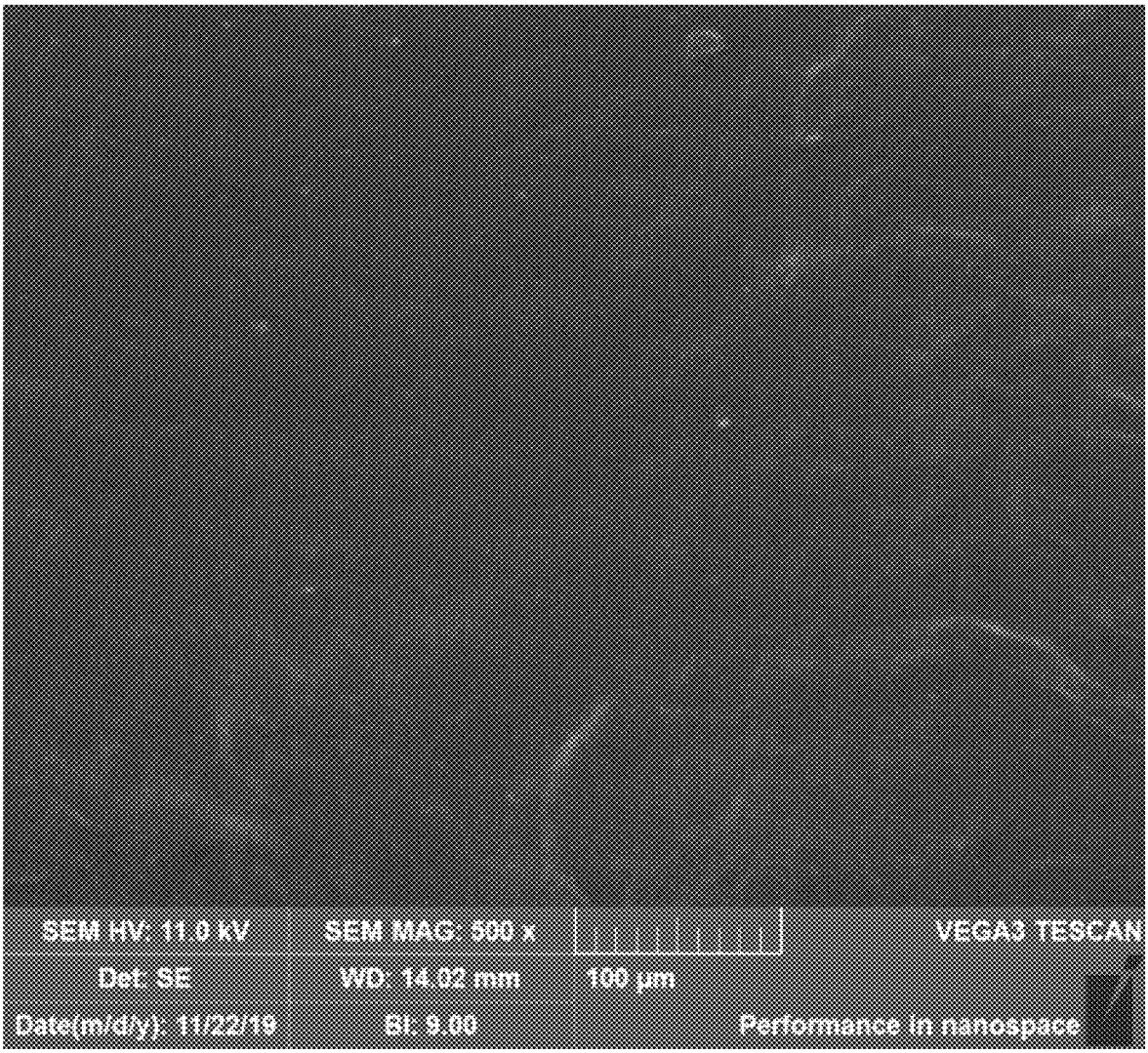
FIG. 3 is a SEM image of the surface of aramid paper coated with aramid nanofiber prepared in Example 7.

The aramid paper coated with aramid nanofibers prepared in this example was tested with a pressure tester. The test results showed that the compressive strength of aramid nanofiber coated aramid paper was 25.12 KV/mm. The tensile strength was 26.5 MPa and the Young's modulus was 0.74 GPa as measured by a servo material control testing machine. FIG. 3 is a SEM image of the surface of aramid paper coated with aramid nanofiber prepared in Example 7.

EXAMPLE 8

A method of preparing aramid paper coated with aramid nanofibers includes the following steps:

(1) Preparation of aramid paper: Meta-aramid fibrids and chopped meta-aramid fibers were dissolved in water to prepare a meta-aramid fibrid slurry and a chopped meta-aramid fiber slurry. The slurries were mixed, stirred, filtered, pressed, and dried to obtain a meta-aramid paper with a paper weight of 60 g/m$^2$. A dry weight ratio of the chopped meta-aramid fibers and the meta-aramid fibrids was 10:90.

(2) Preparation of para-aramid nanofiber coating solution: potassium hydroxide, deionized water, dimethyl sulfoxide, and para-aramid nanofibers were added to a container in a weight ratio of 7.5:20:500:5, and stirred for 2 hours, to obtain the para-aramid nanofiber coating solution. The weight concentration of para-aramid nanofibers was 1% based on the weight of the dimethyl sulfoxide.

(3) Preparation of aramid paper coated with aramid nanofibers: the para-aramid nanofiber coating solution was applied on one surface of the aramid paper with a coating rod. The coated aramid paper was washed with deionized water for 2 hours, and dried for 5 minutes at 105° C. The para-aramid nanofiber coating solution was applied on the other surface of the aramid paper with a coating rod. The coated aramid paper was washed with deionized water for 2 hours, and dried for 5 minutes at 105° C. The coated aramid paper was finally hot pressed at 200° C. and under 10 MPa for 5 minutes to obtain the aramid paper coated with aramid nanofibers.

The aramid paper coated with aramid nanofibers prepared in this example was tested with a pressure tester. The test results showed that the compressive strength of aramid nanofiber coated aramid paper was 20.17 KV/mm. The tensile strength was 23.45 MPa and the Young's modulus was 0.62 GPa as measured by a servo material control testing machine.

Figure 4:
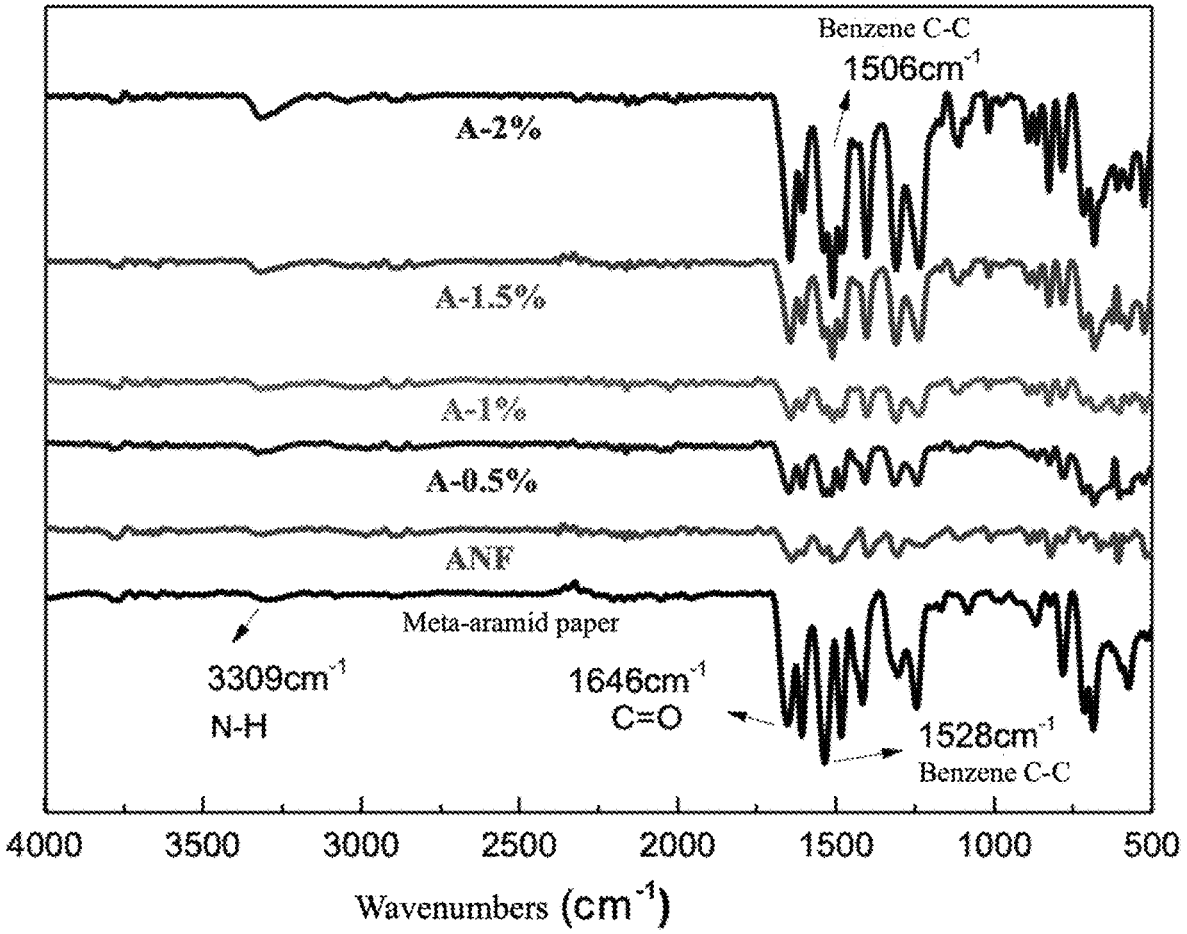
FIG. 4 is the infrared spectrum of aramid paper coated with aramid nanofibers in different concentrations.

FIG. 4 is the infrared spectrum of the aramid paper (no coating), the para-aramid nanofibers, the aramid paper coated with 0.5% aramid nanofibers (A-0.5%; Example 7), the aramid paper coated with 1% aramid nanofibers (A-1%; Example 1), the aramid paper coated with 1.5% aramid nanofibers (A-1.5%; Example 6), and the aramid paper coated with 2% aramid nanofibers (A-2%; Example 2).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of preparing an aramid paper coated with aramid nanofibers comprising the following steps:

(1) mixing a meta-aramid fibrid slurry and a chopped meta-aramid fiber slurry, filtering, pressing and drying to obtain a meta-aramid paper;

(2) mixing potassium hydroxide, deionized water, dimethyl sulfoxide, and para-aramid nanofibers in a container, and stirring to obtain a para-aramid nanofiber coating solution; and (3) applying the para-aramid nanofiber coating solution to a first side of the meta-aramid paper, washing with deionized water, and drying; applying the para-aramid nanofiber coating solution to a second side of the meta-aramid paper, washing with deionized water, and drying; and hot pressing to obtain the aramid paper coated with aramid nanofibers.

2. The method according to claim 1, wherein in the step (1), a dry mass ratio of the meta-aramid fibrid slurry and the chopped meta-aramid fiber slurry is (0-50):(100-50).

3. The method according to claim 1, wherein in the step (1), the meta-aramid fibrid slurry and a chopped meta-aramid fiber slurry are stirred at 20,000 rpm, then at 3,000 rpm, and filtered, pressed and dried in a papermaking machine to obtain the meta-aramid paper.

4. The method according to claim 1, wherein a paper weight of the meta-aramid paper obtained in the step (1) is 60 $g/m^2$.

5. The method according to claim 1, wherein in the step (2), a weight ratio of the potassium hydroxide:the deionized water:the dimethyl sulfoxide:the para-aramid nanofibers is (3.75-15):20:500:(2.5-10).

6. The method according to claim 1, wherein in the step (2), the potassium hydroxide, the deionized water, the dimethyl sulfoxide, and the para-aramid nanofibers are stirred for 4 hours.

7. The method according to claim 1, wherein in the para-aramid nanofiber coating solution of the step (2), the para-aramid nanofibers have a weight concentration of 0.5%-2% based on an amount of the dimethyl sulfoxide.

8. The method according to claim 1, wherein in the step (3), the first side of the meta-aramid paper is washed with the deionized water for 0.5-2 hours, dried at 105° C. for 3-8 minutes; and the second side of the meta-aramid paper is washed with the deionized water for 0.5-2 hours, dried at 105° C. for 3-8 minutes.

9. The method according to claim 1, wherein in the step (3), the meta-aramid paper is hot pressed at 150-200° C., at a pressure of 5-10 MPa, for 3-20 minutes.

* * * * *